US009010431B2

(12) United States Patent
Billington et al.

(10) Patent No.: US 9,010,431 B2
(45) Date of Patent: Apr. 21, 2015

(54) SUBSEA ORIENTATION AND CONTROL SYSTEM

(75) Inventors: Anders Billington, Baerums Verk (NO); Are Synnes, Hovik (NO); Christen Sovik, Blystadlia (NO)

(73) Assignee: Aker Subsea AS, Lysaker (NO)

( * ) Notice: Subject to any disclaimer, the term of this patent is extended or adjusted under 35 U.S.C. 154(b) by 183 days.

(21) Appl. No.: 13/637,684

(22) PCT Filed: Apr. 13, 2011

(86) PCT No.: PCT/EP2011/055765

§ 371 (c)(1),
(2), (4) Date: Dec. 12, 2012

(87) PCT Pub. No.: WO2011/128355

PCT Pub. Date: Oct. 20, 2011

(65) Prior Publication Data

US 2013/0220625 A1 Aug. 29, 2013

(30) Foreign Application Priority Data

Apr. 14, 2010 (NO) ..... 20100532

(51) Int. Cl.

| | |
|---|---|
| ***E21B 33/035*** | (2006.01) |
| ***E21B 41/04*** | (2006.01) |
| ***E21B 19/00*** | (2006.01) |
| ***E21B 47/10*** | (2012.01) |

(52) U.S. Cl.

CPC ..... *E21B 19/002* (2013.01); *E21B 41/04* (2013.01); *E21B 47/1025* (2013.01)

(58) Field of Classification Search

CPC .... E21B 33/035; E21B 41/04; E21B 47/1025
USPC ..... 166/336, 338, 339, 360, 368, 250.01; 405/190, 191

See application file for complete search history.

(56) References Cited

U.S. PATENT DOCUMENTS

| | | | | |
|---|---|---|---|---|
| 3,165,899 | A * | 1/1965 | Shatto, Jr. | 405/191 |
| 3,166,123 | A | 1/1965 | Watkins | |
| 3,741,320 | A | 6/1973 | Hilfing | |
| 4,730,677 | A * | 3/1988 | Pearce et al. | 166/345 |
| 5,046,895 | A * | 9/1991 | Baugh | 405/188 |
| 5,273,376 | A * | 12/1993 | Ritter, Jr. | 405/169 |

(Continued)

FOREIGN PATENT DOCUMENTS

| | | | |
|---|---|---|---|
| WO | WO-02/14651 | A1 | 2/2002 |
| WO | WO-2006/099316 | A1 | 9/2006 |

(Continued)

OTHER PUBLICATIONS

Rampelmann, K., "International Search Report", for PCT/EP2011/055765, as mailed Dec. 1, 2011, 6 pages.

(Continued)

*Primary Examiner* — Matthew Buck
(74) *Attorney, Agent, or Firm* — Winstead PC

(57) ABSTRACT

A tool for subsea installation and testing of wellhead modules such as Xmas trees and similar equipment, from a ship using a ship crane. The tool includes a subsea unit that includes a connector for releasable connection to subsea wellhead modules or equipment, means for positioning and means for testing, and a connector for electric power and electric and/or optical control.

11 Claims, 4 Drawing Sheets

(56) References Cited

U.S. PATENT DOCUMENTS

Figure 1:
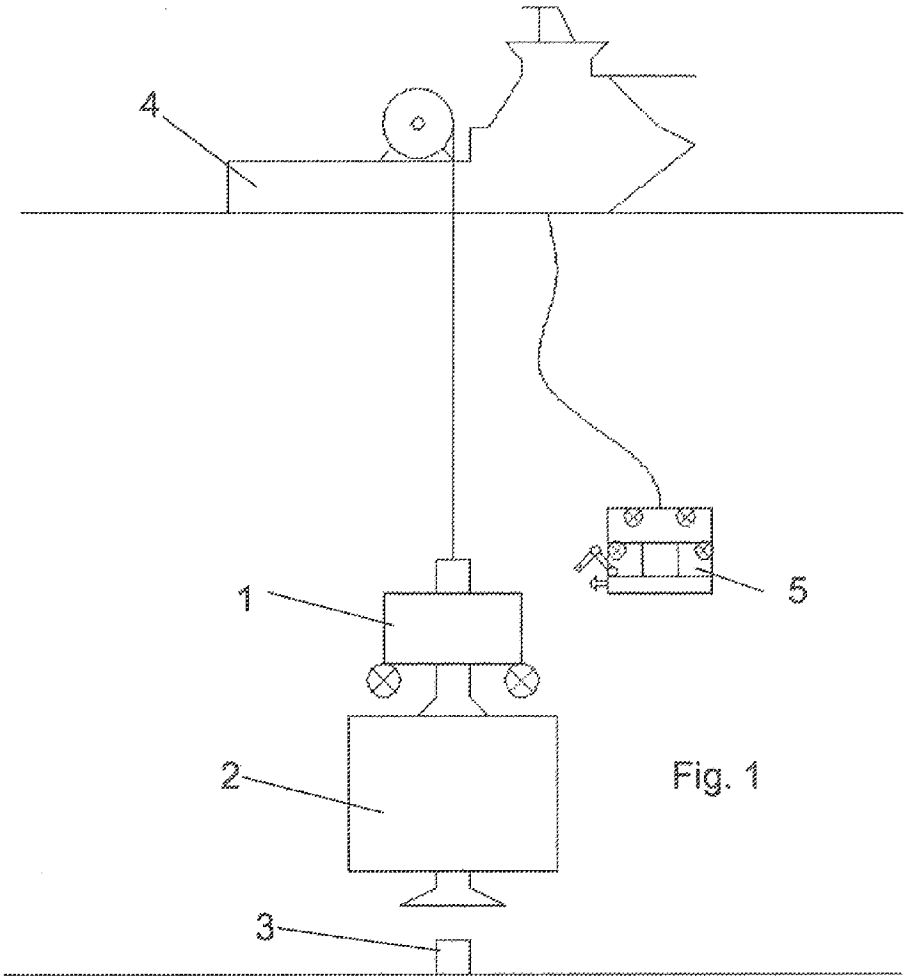

| | | | | |
|---|---|---|---|---|
| 6,068,427 | A * | 5/2000 | Østergaard | 405/191 |
| 6,257,162 | B1 * | 7/2001 | Watt et al. | 114/244 |
| 6,343,654 | B1 | 2/2002 | Brammer | |
| 6,588,980 | B2 * | 7/2003 | Worman et al. | 405/158 |
| 6,588,985 | B1 * | 7/2003 | Bernard | 405/191 |
| 6,935,262 | B2 * | 8/2005 | Roodenburg et al. | 114/258 |
| 7,062,960 | B2 * | 6/2006 | Couren et al. | 73/152.51 |
| 7,063,157 | B2 * | 6/2006 | Bartlett | 166/339 |
| 7,165,619 | B2 * | 1/2007 | Fox et al. | 166/343 |
| 7,331,394 | B2 * | 2/2008 | Edwards et al. | 166/339 |
| 7,891,429 | B2 * | 2/2011 | Boyce et al. | 166/340 |
| 8,381,578 | B2 * | 2/2013 | Sweeney | 73/49.1 |
| 8,430,168 | B2 * | 4/2013 | Goodall et al. | 166/336 |
| 2003/0167997 | A1 * | 9/2003 | Colyer | 114/258 |
| 2004/0094305 | A1 | 5/2004 | Skjærseth et al. | |
| 2005/0061513 | A1 * | 3/2005 | Johansen et al. | 166/336 |
| 2008/0017383 | A1 * | 1/2008 | Minassian et al. | 166/338 |
| 2009/0038805 | A1 | 2/2009 | Parks et al. | |
| 2009/0255681 | A1 * | 10/2009 | Spencer | 166/341 |
| 2010/0012326 | A1 | 1/2010 | Sundararajan et al. | |
| 2011/0315392 | A1 * | 12/2011 | Edwards | 166/338 |

FOREIGN PATENT DOCUMENTS

| | | | |
|---|---|---|---|
| WO | WO-2010/020956 | A2 | 2/2010 |
| WO | WO-2010/030190 | A2 | 3/2010 |

OTHER PUBLICATIONS

Nicacio, Rafael Mendes Pinto, "SESV (Subsea Equipment Support Vessel): An Alternative Resource for Rig Opeations", DOT Conference New Orleans, Feb. 2009, (14 pages).

* cited by examiner

SUBSEA ORIENTATION AND CONTROL SYSTEM

FIELD OF THE INVENTION

The present invention relates to subsea wellhead stacks. More specifically, the invention relates to tools and methods for installation of wellhead stacks, such as wellhead XT (Christmas trees) and associated equipment.

BACKGROUND OF THE INVENTION AND PRIOR ART

Currently, subsea wellhead stacks are typically installed by using a drilling rig and a string of drillpipe for deployment. A separate umbilical from the rig to the wellhead equipment provides pressurized fluids for testing and commissioning, in addition to electric power and control lines. Typically one or more ROV's are also used in the operation. The time and equipment used is very expensive. In shallow waters, if the drilling rig is on the field and has commenced drilling and then is used to install a few production XT (Christmas trees) and other related equipment, this can be sensible, particularly if the drilling rig still is under contract. However, in deep water, which can be thousands of meters of depth, and with a large number of wellheads, the cost can be tremendous. Sometimes the rig must return for further testing or installation, which adds to the costs. The operation of joining drill pipes to lengths of up to several thousand meters, and large drums with umbilicals, installations for hydraulic power units, hydraulic liquid storage and gas for testing, are all expensive and time consuming. The heavy weight and size require large space, and may require several containers on deck on the rig. Therefore, a demand exists for technology useful for installation and testing of subsea wellhead stacks without using a drilling rig, and technology that make significant cuts in the required equipment and the period of time for such operation.

SUMMARY OF THE INVENTION

The present invention meets the above mentioned demand.

More specifically, the invention provides a tool for subsea installation and testing of wellhead modules such as Xmas trees and similar equipment, from a ship using a ship crane, distinctive in that the tool comprises

- a subsea unit comprising a connector for releasable connection to subsea wellhead modules or equipment, means for positioning and means for testing, and a connector for electric power and electric and/or optical control.

The tool has no supply of hydraulic liquid or gas via umbilical or other pressure line from the surface, as only electric power and electric and/or optical control signals are transferred between the surface position and the wellhead area. The tool is adapted for being handled by a ship crane, as hanging in a wire or rope connected via lifting lugs, a spreader or similar means. The tool comprises a topsides control means and connection to electrical power and control means, in addition to the subsea unit. The subsea unit is connected to the topsides facilities by an electrical/optical umbilical, optionally via an ROV connected to the subsea unit, i.e. the umbilical of a work-ROV system can be used for power and control. Accordingly, there is no riser or hose for pressurized fluid from the ship down to the tool, neither for installation, commissioning nor testing, which provides a huge advantage of the invention over conventional technology, particularly where the depth is large and the wellhead stacks are many.

The tool is useful for installation and testing of all functions, and communication to all sensors, for subsea equipment, particularly wellhead production X-mas trees, -modules, pumps compressors and units of different types, particularly equipment that is too heavy and/or large to be installed and tested using conventional ROV systems and tools.

Preferably, the tool comprises means for connecting the subsea unit to an ROV (remotely operated vehicle) for power and control of the subsea unit from a topside control unit via the ROV and its umbilical. The means for connecting to an ROV is preferably one or more docking stations with receptacles and connectors operatively connectable with corresponding means of the ROV. Connectors are separate or common for hydraulic power, electric power and signals, most ROV operators can provide such connectors, for example hot stabs with inductive or contact connectors for electric power and/or signals.

The means for positioning preferably comprises thrusters integrated in the tool and thrust force applied from optional docked ROV's, in addition to a crane on the ship. Also the lifting lugs, spreaders, etc, can be considered as means for positioning, allowing positioning by being hung up in a crane wire or rope.

The subsea unit preferably comprises means for determining the position and orientation, comprising a gyro in the subsea unit, the positioning system of an optionally connected ROV, and optional further position sensors in the subsea unit, wellhead modules and equipment, and wellhead instrumentation, and optional cameras on the tool and wellhead modules or equipment.

The tool comprises means for testing and commissioning, preferably comprising fluid banks, such as nitrogen gas accumulators and cylinders for seal and pressure testing; and means for mechanical connection to the wellhead and disconnection of the subsea unit after operation testing of mechanical functions, such as valve functions, and hydraulic liquid filling, such as an MEG bank and a hydraulic power unit in the subsea unit or/and in an optional ROV system connected via hot stabs or similar. Preferably the subsea unit has a hydraulic power unit comprising a hydraulic motor driven by the hydraulics of the ROV, the hydraulic circuits of the subsea unit conveniently using MEG as hydraulic fluid.

The invention also provides a method for installation of subsea wellhead modules or equipment, such as a XT (Christmas tree), from a ship using a ship crane, using the tool of the invention, distinctive by deploying the wellhead module or equipment releasably connected to the subsea unit of said tool, using a mechanical connector and the ship crane but without umbilical or line providing liquid or gas from the surface, but using the tool as connected to a fluidless electrical or electrical-optical umbilical or a ROV for positioning and connecting to a subsea wellhead.

Preferably the method also comprises steps for pressure and function testing, and disconnecting the tool from the wellhead module or equipment after said testing.

Further, the invention provides means for pressure testing of subsea wellhead modules or equipment, distinctive in that the means comprises a gas filled accumulator and a gas filled cylinder, having connectors for sealingly mechanical connection and connectors for power and control, for operatively connecting to the subsea wellhead module or equipment for testing. The means is included in the tool of the invention or is included or releasably connected to other subsea equipment, like pumps, compressors and subsea modules.

Also, the invention provides a method for installation of subsea wellhead modules such as Xmas trees and similar equipment, from a ship using a ship crane, using the tool of the invention, distinctive by:

sealingly connecting a gas filled accumulator and a gas filled cylinder, and connectors for power and control, to the subsea module or equipment, evacuating water from the volume to be tested, by opening the accumulator in order to displace the water with gas, pressurizing to test pressure, by operating the cylinder, and monitoring the pressure for a prescribed period of time.

FIGURES

Figure 2:
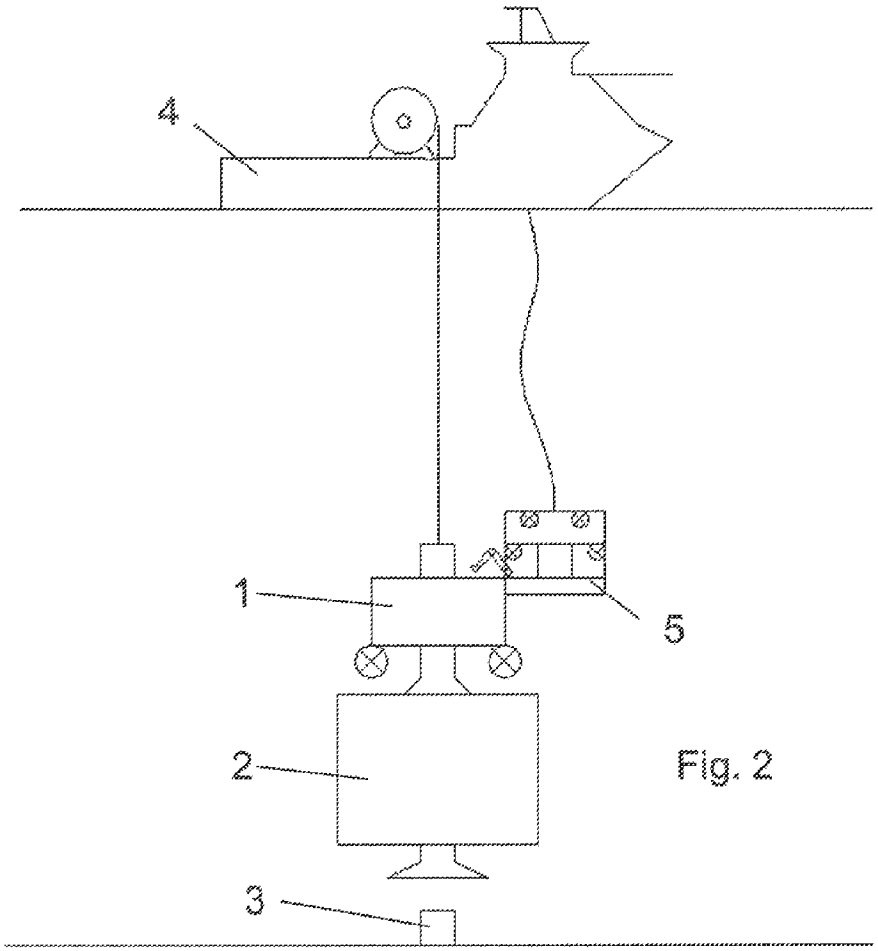
Figure 3:
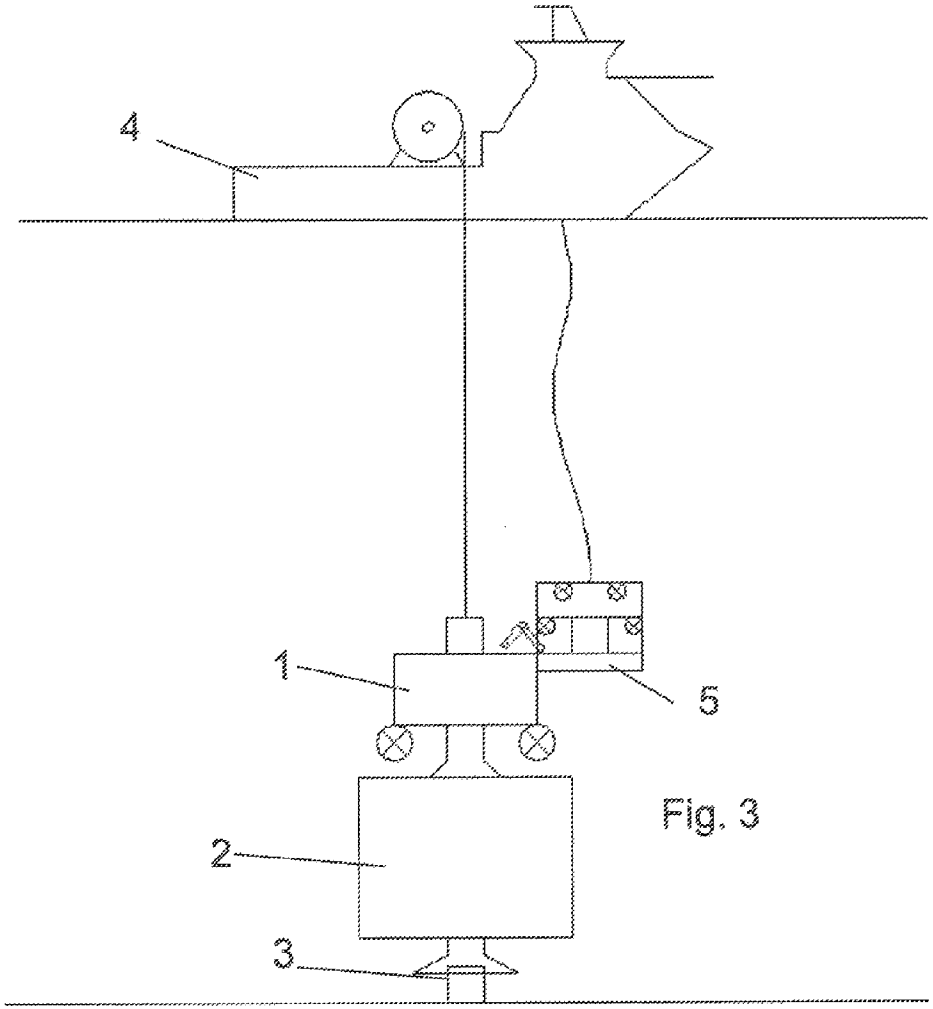
Figure 4:
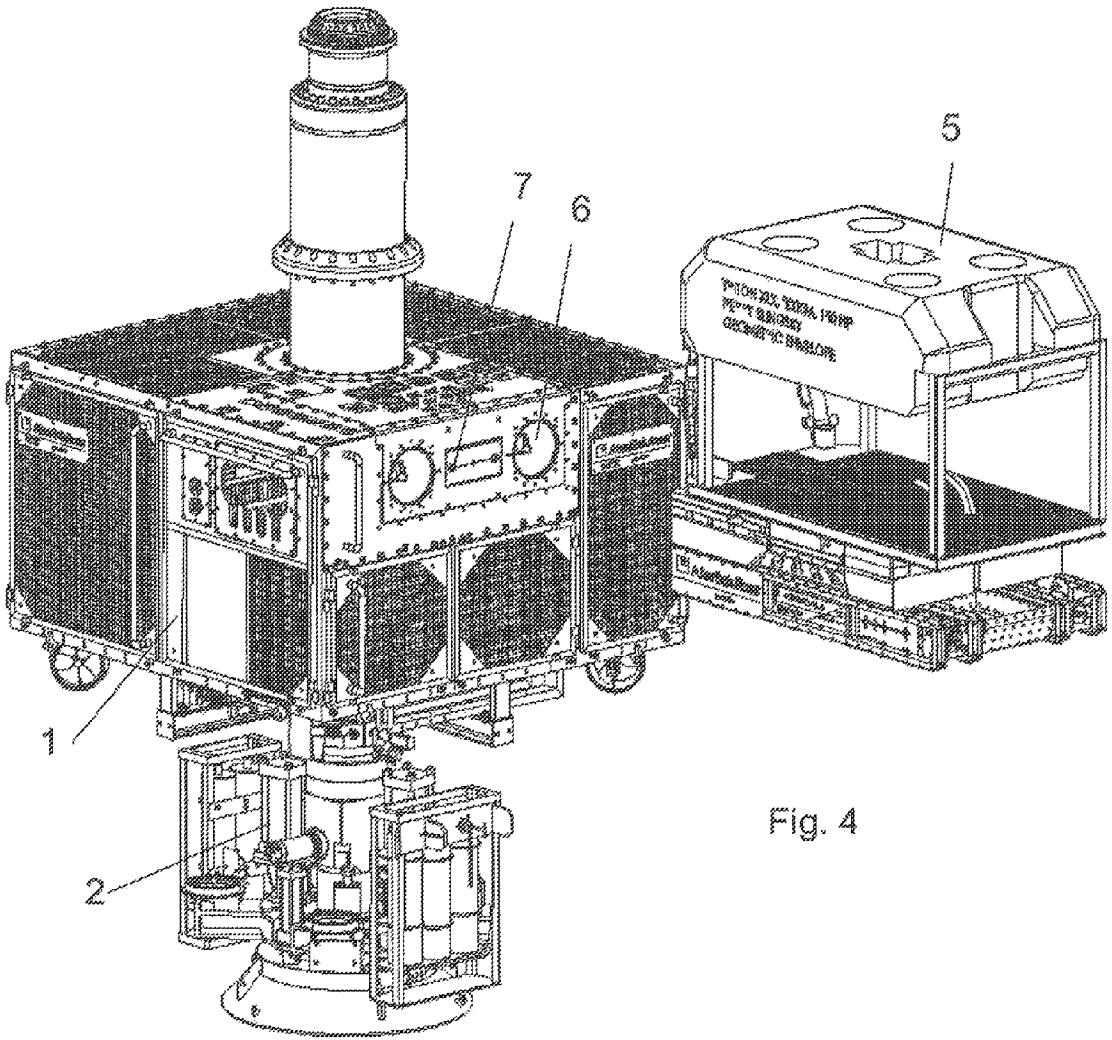

The invention is illustrated with four figures, of which:

FIG. 1 illustrates a tool according to the invention, before connection to a wellhead, FIG. 2 illustrates the tool of FIG. 1, still before connection to a wellhead, but as connected to a ROV, FIG. 3 illustrates the tool of FIGS. 1 and 2, as connected to a wellhead, and FIG. 4 is a more detailed illustration of a tool of the invention.

DETAILED DESCRIPTION

Reference is made to FIG. 1, illustrating a tool according to the invention, more specifically a subsea unit 1 of the tool, as releasably connected to a subsea x-mas tree 2, for connection to a subsea wellhead 3. The assembly is deployed as hanging from a ship 4. Also, a ROV 5 is illustrated, operated from the ship. Reference is then made to FIG. 2, illustrating that the ROV has docked to the subsea unit 1. In the illustrated embodiment, the assembly of the subsea unit 1 and the x-mas tree 2 hangs in a rope from the ship, and electric power and control signals are provided via the ROV, via the electrical-optical umbilical of the ROV, using the hydraulic power unit of the ROV for driving a hydraulic system of the subsea unit via a hydraulic converter pump. Alternatively, the subsea unit could be directly connected to a fluidless umbilical, the subsea unit per se including all means for operating and testing mechanical, electrical and any other devices, or the means could be provided from the ROV system to a full or larger extent. Also, an observation ROV can be used to facilitate the operation. The illustrated subsea unit weighs about 24 metric tons, the releasably connected x-mas tree weights about 40 metric tons. FIG. 3 illustrates the x-mas tree 2 as connected to the wellhead 3. After testing connection, valve functions and communication with all sensors in the subsea system, the subsea unit 1 is disconnected from the x-mas tree.

FIG. 4 is a more detailed illustration of a tool of the invention. Similar items are designated with the same reference numerical in all figures. FIG. 4 clearly shows inter alia a ROV docking station on the subsea unit, as receptacles 6 and hot stab ports 7 are illustrated.

The invention claimed is:

1. A tool for subsea installation and testing of wellhead Xmas trees and similar equipment, from a ship using a ship crane, the tool comprising:

a subsea unit comprising a connector for releasable connection to the Xmas tree;

thrusters integrated in the tool for positioning of the connected Xmas tree on a wellhead for installation;

accumulators for water evacuation and cylinders for pressure and valve function testing of the Xmas tree for testing and commissioning; and a connector for at least one of electric power and electric and optical control.

2. The tool according to claim 1, wherein the tool has no supply of hydraulic liquid or gas via umbilical or other pressure line from a surface position, as only at least one of electric power and electric and optical control signals are transferred between the surface position and the Xmas tree.

3. The tool according to claim 1, wherein the tool comprises at least one docking station for connecting the subsea unit to an ROV (remotely operated vehicle) for power and control of the subsea unit from a topside control unit via the ROV and its umbilical.

4. The tool according to claim 1, wherein thrust force applied from optional docked ROV's and the crane on the ship facilitate positioning of the connected Xmas tree on the wellhead for installation.

5. The tool according to claim 1, wherein the subsea unit comprises, for determining the position and orientation, a gyro in the subsea unit, a positioning system of an optionally connected ROV, and optional further position sensors in the subsea unit, wellhead modules and equipment, and wellhead instrumentation, and optional cameras on the tool and the Xmas tree.

6. The tool according to claim 1, wherein the accumulators comprise fluid banks; and equipment for mechanical connection to the wellhead and disconnection of the subsea unit after operation testing of mechanical functions, the mechanical functions including at least one of valve functions, and hydraulic liquid filling, the equipment for mechanical connection comprises at least one of MEG banks and a hydraulic power unit in at least one of the subsea unit and an optional ROV system connected via hot stabs or similar.

7. A method for installation of subsea wellhead Xmas trees and similar equipment, from a ship using a ship crane, using the tool of claim 1, wherein the method comprises:

deploying the wellhead Xmas trees as releasably connected to the subsea unit of said tool, using the ship crane but without any umbilical or line providing liquid or gas from a surface, but using the tool as connected to a fluidless electrical or electrical-optical umbilical or a ROV for positioning and connecting to a subsea wellhead.

8. The method according to claim 7, wherein the method comprises steps for pressure and function testing, and disconnecting the tool from the Xmas tree after said testing.

9. The tool according to claim 6, wherein the fluid banks are nitrogen gas accumulators.

10. An apparatus for pressure testing of subsea wellhead modules or equipment, the apparatus comprising:

a gas filled accumulator for water evacuation; and a gas filled cylinder, the gas filled cylinder having connectors for mechanical seal connections and connectors for power and control, the gas filled cylinder for operatively connecting to the subsea wellhead module or equipment for testing pressure and valve functions of the subsea wellhead module or equipment.

11. A method for pressure testing of subsea wellhead modules or equipment using the apparatus of claim 10, the method comprises:

sealingly connecting a gas filled accumulator and a gas filled cylinder, and connectors for power and control, to the subsea module or equipment;

evacuating water from a volume to be tested, by opening the accumulator in order to displace the water with gas;

pressurizing to test pressure, by operating the cylinder; and monitoring the pressure for a prescribed period of time.

* * * * *